United States Patent [19]

Grüner et al.

[11] Patent Number: 4,539,042

[45] Date of Patent: Sep. 3, 1985

[54] PREVENTING AN INCREASE OF THE NITROGEN CONTENT IN MOLTEN STEEL

[75] Inventors: Hans Grüner; Arnold Pfeiffer, both of Duisburg; Heinrich-Wilhelm Rommerswinkel, Muelheim-Saarn; Rolf Vest, Monchen-Gladbach, all of Fed. Rep. of Germany

[73] Assignee: Mannesmann AG, Duesseldorf, Fed. Rep. of Germany

[21] Appl. No.: 582,439

[22] Filed: Feb. 22, 1984

[30] Foreign Application Priority Data

Feb. 23, 1983 [DE] Fed. Rep. of Germany ..... 3306782

[51] Int. Cl.[3] ..... C21C 7/00

[52] U.S. Cl. ..... 75/43; 75/53

[58] Field of Search ..... 75/43, 53–59

[56] References Cited

U.S. PATENT DOCUMENTS

| | | | |
|---|---|---|---|
| 3,876,421 | 4/1975 | Takemura | 75/53 |
| 3,999,978 | 12/1976 | Furuya | 75/53 |
| 4,014,684 | 3/1977 | Jones | 75/53 |
| 4,130,423 | 12/1978 | Chastant | 75/53 |
| 4,266,969 | 5/1981 | Koros | 75/53 |

*Primary Examiner*—Peter D. Rosenberg

*Attorney, Agent, or Firm*—Ralf H. Siegemund

[57] ABSTRACT

Following the discharge of steel from a steel producing converter, the adding and inclusion of nitrogen is impeded by surrounding the stream of pouring steel with a layer of limestone at a grain size not exceeding 5 mm. Practice has shown that the nitrogen content can well remain below a content of 0.005%.

7 Claims, 1 Drawing Figure

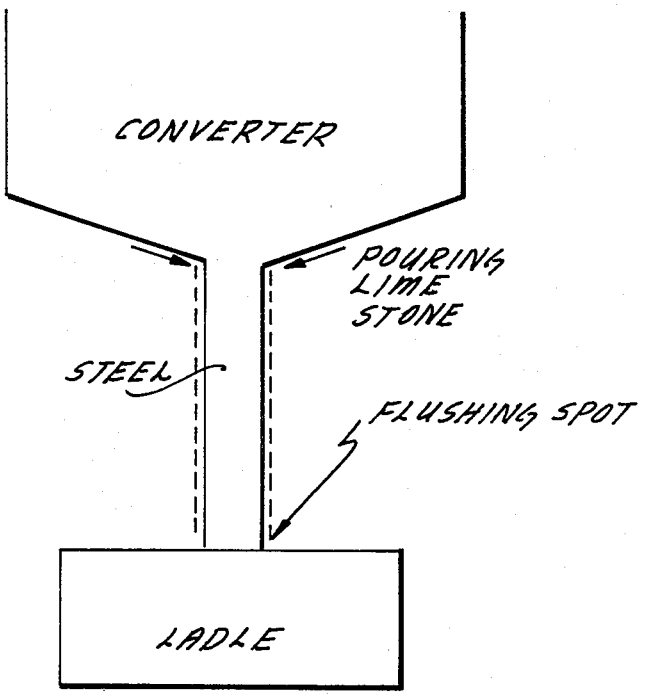
CONVERTER
POURING
LIME
STONE
STEEL
FLUSHING SPOT
LADLE

PREVENTING AN INCREASE OF THE NITROGEN CONTENT IN MOLTEN STEEL

BACKGROUND OF THE INVENTION

The present invention relates to a process for treating molten steel particularly steel which has been deoxidized and quieted and killed.

It is known generally that molten steel will accept and include nitrogen upon being in contact with air. This phenomenon was particularly observed during the so called Thomas process. On the other hand, it is well known that certain grades of steel should not include a particular amount of nitrogen particularly because of the nitrite curing. This so called nitrite curing has been reduced or even eliminated in the past through the addition of components having a certain affinity to nitrogen such as vanadium, aluminum or titanium. On the other hand, this particular approach brings with it a reduction in the capability of the resulting steel concerning hot working deformation. Moreover, steel made with an eye on very high strength may, however, exhibit a reduced weldability by this procedure. Generally speaking, it appears that the maximum content of nitrogen that can be tolerated for a variety of reasons and in different grades of steel is about 0.005%.

DESCRIPTION OF THE INVENTION

Certain research programs have resulted in the fact that modern oxygen blowing (blasting) methods for the steel manufacture provide nitrogen contents at the end of the blasting process in the order of 20–30 parts per million, which is about 0.002–0.003% with an average of around 25 parts per million. Upon discharge of the molten steel from the converter, the pouring material offers a significant surface to the ambient air. This invites directly accepting and inclusion of nitrogen. Aside from the well known oxidation of the steel during this discharge process, some acceptance and inclusion of additional nitrogen is inevitable. Experiements have shown that the nitrogen content may increase to 48 even up to 65, parts per million. An average of 50 parts per million is quite normal. Moreover, it was found that during subsequent metallurgical processes in the ladle still entails an additional inclusion of nitrogen which cannot be prevented entirely even if the ladle is covered and even though the surface of the molten steel is in fact covered with slag. These subsequent processes in fact raise the nitrogen content to 55 even up to 70, parts per million, with an average of 60 parts per million being quite normal. These values have to be expected in the case of a large variety of metallurgical processes including, for example, desulphurization or post deoxidation under utilization of metallic earth alkaline material. But even in the case of simple gas flushing for purposes of temperature compensation and normalization, such increase in the nitrogen content of the steel was observed.

Having recognized the particular phases in the steel making process which lead to a more or less stepwise increase in the nitrogen content of the steel beyond the tolerable level, it is an object of the present invention to provide a new and improved method for processing accompaniment for the protection of molten steel, such supplemental process not being directly a part of the smelting process but permitting the reduction in the supplemental inclusion of nitrogen following the initial low content of the steel.

It is a particular object of the present invention to reduce the amount of nitrogen which steel may assume subsequent to the steel smelting process proper and prior to any casting process even if these intermediate processes include utilization of ladles or the like for purposes of enhancing the specific metallurgical properties of the material whereby particularly processes deemed necessary for obtaining a particular quality and which are to precede the casting process should be maintained.

It is therefore a specific object of the present invention to prevent or at least impede the inclusion of additional nitrogen in steel which has been deoxidized and killed but has to be treated metallurgically in one way or the other prior to casting.

In accordance with the preferred embodiment of the present invention, it is suggested to use as an inclusion material which yields carbon dioxide and to surround the molten material pouring from a metallurgical smelting furnace or the like generally into a casting ladle vessel or the like by a fine grain material which yields through chemical split off carbon dioxide. In particular, it is suggested to surround this pouring stream of molten steel by a flow sheath of an inert gas other than nitrogen but containing carbonate with a grain size not exceeding 5 mm. This particular material will be, so to speak, added to the stream of pouring steel immediately and directly underneath the opening through which the molten steel is discharged and this additional material is added continuously over the entire period of time during which steel pours into the casting vessel. Alternatively, this protective and supplemental material may actually be introduced into the vessel into which the steel pours above the surface of the molten steel collects therein.

The supplemental material should be added to the casting vessel on a continuous basis, at least for the period of time during which the steel is treated through a flushing gas. The material, in fact, should be added to or above the flushing spot. In each of these instances above, it is suggested to use limestone with a grain size below 5 mm for covering molten steel against the inclusion of oxygen that may be accepted otherwise by the molten steel from the outside.

EXAMPLE

The invention, and particularly the best mode of practicing the preferred embodiment of the present invention, will be explained with reference to the following example. It may be assumed that a steel converter contains molten steel at an amount of 225 tons following a blasting process with an analysis of the constituents (other than iron) as follows: 0.04% carbon, 0.21% manganese, 0.013% phospherous, 0.021% sulphur, 0.0021% nitrogen, all percentages by weight. Moreover, it is assumed that the molten steel of such a consistency has a temperature of 1,662° C. Now during discharge of this molten steel from the converter into a casting ladle, the steel is alloyed and deoxydized under utilization of 3,780 kg silicomanganese and 275 kg ferrosilicon. Simultaneously to these normal and regular operations, the stream and flow of molten metal is protected during the entire pouring run of 4 minutes by 1,000 kg limestone sand with a grain size not exceeding 5 mm and applied in a carrier gas such as Argon. This particular granular material is added continuously as stated during the pouring of the molten steel by means of a mechanically operating pouring equipment.

As shown in the drawing, this particular material pours around the molten steel directly below the discharge opening from the converter such that the sand surrounds the pouring steel and reaches the ladle at the same time.

Following the discharge of the converter, it was found that the ladle material had the following consistency. In addition to iron, this molten material included 0.09% carbon, 0.39% silicon, 1.37% manganese, 0.013% phospherous, 0.013% sulphur, 0.035% aluminum, and 0.0028% nitrogen, all percentages by weight, and the ladle temperature was 1,595° C.

The steel was not desulphurized in the ladle and the particular alloy composition was adjusted under continuous adding of limestone sand during the entire active process. The feeding rate of this supplement material amounted to 50 kg per minute over a 12 minute period. Following this treatment, the molten steel yields the following composition: in addition to iron, it has 0.1% carbon, 0.39% silicon, 1.48% manganese, 0.014% phospherous, 0.0025% sulphur, 0.041% aluminum and 0.0029% nitrogen, at a temperature of 1,562° C. It can readily be seen that under these circumstances the amount of nitrogen was well below the permissable limit. It is believed that this reduction in nitrogen content is unique and has been achieved for the first time.

The invention is not limited to the embodiments described above but all changes and modifications thereof not constituting departures from the spirit and scope of the invention are intended to be included.

We claim:

1. Method fo preventing the inclusion of nitrogen in molten steel which is treated following a poured discharge from a converter, comprising the steps of protectively enveloping a stream of steel as poured from the converter, with a fine grain material yielding carbon dioxide, the enveloping material reaching a vessel into which the steel is poured simultaneously therewith.

2. Method as in claim 1 wherein the supplemental material includes an inert carrier gas other than nitrogen and further includes a carbonate with a grain size not exceeding 5 mm.

3. Method as in claim 1 wherein the supplemental material is continuously applied to the pouring steel directly underneath a pouring opening, the application to continue throughout the discharge.

4. Method as in claim 1 wherein the supplemental is added above the surface of the molten steel in the vessel into which it is poured.

5. Method as in claim 1 wherein the adding of the supplemental material is carried out in coincidence with flushing gas treatment of the molten steel.

6. Method as in claim 5 comprising the step of adding the material above the flushing spot.

7. Method as in claim 1 wherein the material added is limestone at a grain size not exceeding 5 mm.

* * * * *